US005727778A

United States Patent [19]

Nodar

[11] Patent Number: 5,727,778

[45] Date of Patent: Mar. 17, 1998

[54] PORTABLE ADJUSTABLE CHAIN TYPE CLAMPING DEVICE

[76] Inventor: Felix Nodar, 430 Linden Ave., Westfield, N.J. 07090

[21] Appl. No.: 600,090

[22] Filed: Feb. 12, 1996

[51] Int. Cl.[6] ..... B25B 1/20

[52] U.S. Cl. ..... 269/43; 269/45; 269/296

[58] Field of Search ..... 269/108, 130, 269/131, 132, 43, 45, 902, 296; 29/281.5; 228/49.3

[56] References Cited

U.S. PATENT DOCUMENTS

| | | | |
|---|---|---|---|
| 1,410,553 | 3/1922 | Cox | 269/130 |
| 3,379,431 | 4/1968 | Gill | 269/130 |
| 3,711,920 | 1/1973 | Simmons, Jr. | 269/45 |
| 4,575,061 | 3/1986 | Dille | 269/45 |
| 4,769,889 | 9/1988 | Landman et al. | 269/43 |
| 4,815,719 | 3/1989 | Peters et al. | 269/130 |
| 4,934,673 | 6/1990 | Bahler | 269/130 |
| 5,135,208 | 8/1992 | Diskin | 269/130 |
| 5,265,789 | 11/1993 | Adams | 228/49.3 |
| 5,285,947 | 2/1994 | Depperman | 228/49.3 |
| 5,330,167 | 7/1994 | Plumb | 269/43 |

FOREIGN PATENT DOCUMENTS

| | | | |
|---|---|---|---|
| 53054 | 9/1931 | Germany | 269/43 |

*Primary Examiner*—Timothy V. Eley
*Assistant Examiner*—Lee Wilson
*Attorney, Agent, or Firm*—Richard L. Miller, P.E.

[57] ABSTRACT

A portable chain type pipe vise that includes a frame, at least two clamping main assemblies, and a clamping sub-assembly. The frame is stably restable on a work surface. The at least two clamping main assemblies are longitudinally movable on the frame, so that at least two pipes can be rested in longitudinal alignment with each other. The clamping sub-assembly is disposed at each of the at least two clamping main assemblies, so that the at least two pipes can be retained in longitudinal alignment with each other.

15 Claims, 1 Drawing Sheet

FIG. 1
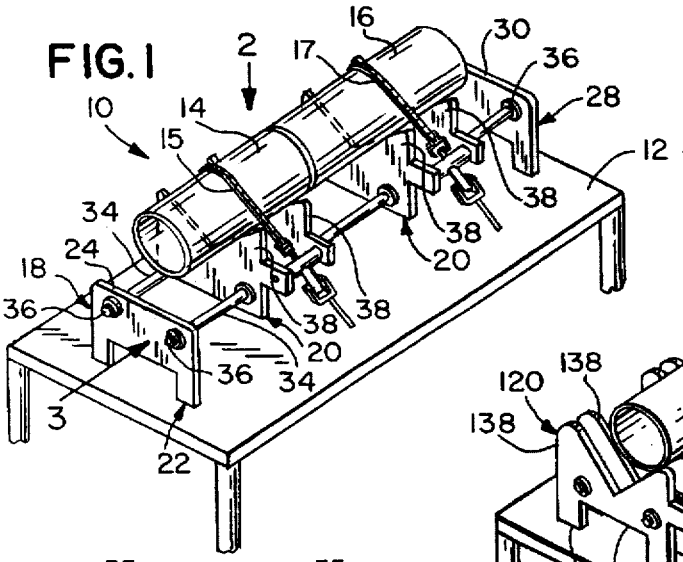
FIG. 6
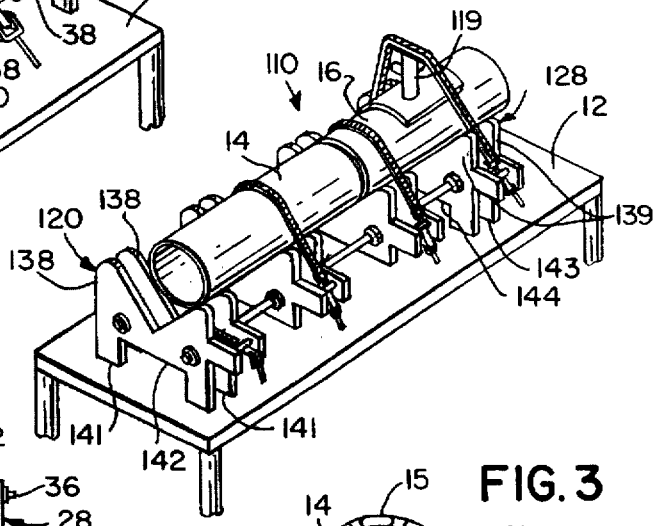
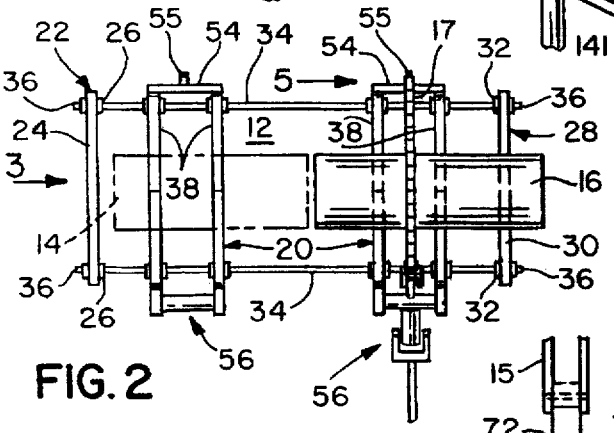
FIG. 2
FIG. 3
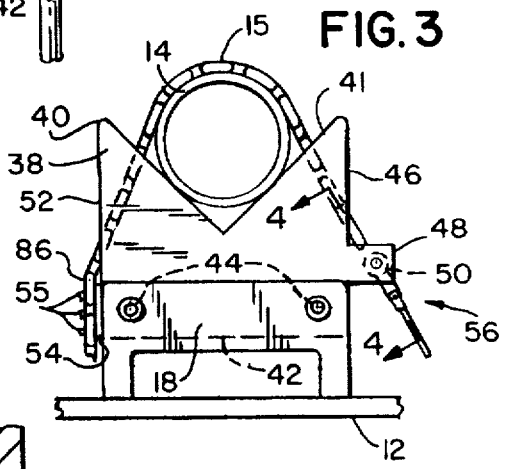
FIG. 4
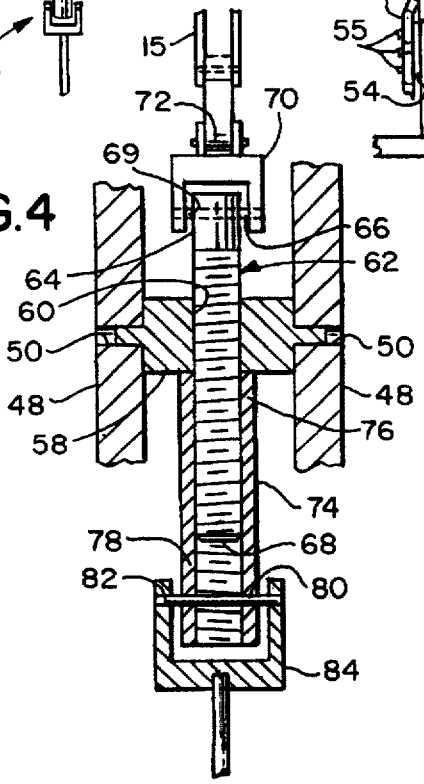
FIG. 5
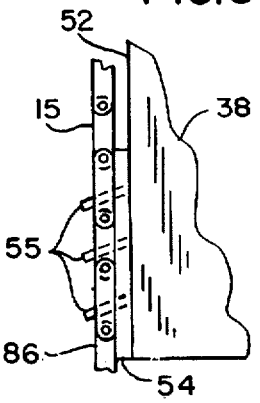

PORTABLE ADJUSTABLE CHAIN TYPE CLAMPING DEVICE

BACKGROUND OF THE INVENTION

The present invention relates to a portable adjustable chain type clamping device. More particularly, the present invention relates to a portable adjustable chain type clamping device that includes an aluminum frame, at least two pair of aluminum support plates that are longitudinally slidably movable on the frame and which contain "V"-shaped recesses for supporting pipes, pipes and coupling, pipes and couplings and fittings, and a chain connected to at least one pair of the at least two pair of aluminum support plates for retaining the pipes, pipes and coupling, and pipes and couplings and fittings in the "V"-shaped recesses.

At many times it is usually necessary to work with section of pipe. These sections must often be cut, welded, or the like prior to use. In the past, it has been difficult to physically retain sections of pipe in a fixed, convenient position so that they may be worked on.

Welding fixtures are often employed during a joining operation of two work pieces, such as welding. The welding fixture serves to temporary retain the work pieces relative to one another.

Numerous innovations for clamping devices have been provided in the prior art that will be described. However, even though these innovations may be suitable for the specific individual purposes to which they address, they differ from the present invention in that they do not teach a portable adjustable chain type clamping device that includes an aluminum frame, at least two pair of aluminum support plates that are longitudinally slidably movable on the frame and which contain "V"-shaped recesses for supporting pipes, pipes and coupling, pipes and couplings and fittings, and a chain connected to at least one pair of the at least two pair of aluminum support plates for retaining the pipes, pipes and coupling, and pipes and couplings and fittings in the "V"-shaped recesses.

FOR EXAMPLE, U.S. Pat. No. 4,815,719 to Peters et al. teaches A chain clamping device that includes a support having a seat for receiving an object to be clamped at least one clamping chain for abutment with the object to hold the object on the support.

ANOTHER EXAMPLE, U.S. Pat. No. 5,135,208 to Diskin teaches a chain guide vise that includes a base member, at least two V-shaped vise members, and a chain having one end attached to the base member. The other end of the chain is designed to wrap around a pipe and extends downwardly beneath the base member to an attachment assembly.

STILL ANOTHER EXAMPLE, U.S. Pat. No. 5,265,789 to Adams teaches an assembly that is arranged for mounting to a pipe to be welded that includes a support pipe having a counterweight slidably mounted therealong. The support pipe includes a V-shaped lock receiving the pipe to be welded, with a clamp chain arranged for securing the pipe to be welded relative to the V-shaped lock.

FINALLY, YET ANOTHER EXAMPLE, U.S. Pat. No. 5,285,947 to Depperman teaches a welding fixture that includes a plurality of shoe assemblies each of which being radially movable between a contracted position and expanded position. Further included is an actuator operatively connected to each of the shoe assemblies for selectively moving each shoe assembly between the contracted position and the expanded position.

It is apparent that numerous innovations for clamping devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT Of the present invention is to provide a chain type pipe vise that avoids the disadvantages of the prior art.

ANOTHER OBJECT of the present invention is to provide a chain type pipe vise that is simple and inexpensive to manufacture.

STILL ANOTHER OBJECT of the present invention is to provide a chain type pipe vise that is simple to use.

YET ANOTHER OBJECT of the present invention is to provide a chain type pipe vise that can clamp two pipes and a coupling therebetween for the process of electro fusion.

STILL YET ANOTHER OBJECT of the present invention is to provide a chain type pipe vise that can clamp two pipes, a coupling therebetween, and a fitting thereon for the process of electro fusion.

YET STILL ANOTHER OBJECT of the present invention is to provide a chain type pipe vise that is portable.

STILL YET ANOTHER OBJECT of the present invention is to provide a chain type pipe vise that is adjustable.

YET STILL ANOTHER OBJECT of the present invention is to provide a chain type pipe vise that can be used in a shop or in the field.

STILL YET ANOTHER OBJECT of the present invention is to provide a chain type pipe vise that can clamp pipes with a diameter in the range of 2 inches to 12 inches.

BRIEFLY STATED, YET STILL ANOTHER OBJECT of the present invention is to provide a chain type pipe vise that includes a frame, at least two clamping main assemblies, and a clamping sub-assembly.

STILL YET ANOTHER OBJECT of the present invention is to provide a chain type pipe vise wherein the frame is stably restable on a work surface.

YET STILL ANOTHER OBJECT of the present invention is to provide a chain type pipe vise wherein the at least two clamping main assemblies are longitudinally movable on the frame, so that at least two pipes can be rested in longitudinal alignment with each other.

STILL YET ANOTHER OBJECT of the present invention is to provide a chain type pipe vise wherein the clamping sub-assembly is disposed at each of the at least two clamping main assemblies, so that the at least two pipes can be retained in longitudinal alignment with each other.

YET STILL ANOTHER OBJECT of the present invention is to provide a chain type pipe vise wherein the frame includes an inverted substantially U-shaped first end plate that has a top and a pair of apertures disposed in proximity to the top of the inverted substantially U-shaped first end plate of the frame.

STILL YET ANOTHER OBJECT of the present invention is to provide a chain type pipe vise wherein the frame further includes an inverted substantially U-shaped second end plate displaced a distance from, and parallel to, the inverted substantially U-shaped first end plate of the frame.

YET STILL ANOTHER OBJECT of the present invention is to provide a chain type pipe vise wherein the inverted substantially U-shaped second end plate has a top and a pair of apertures disposed in proximity to the top of the inverted substantially U-shaped second end plate of the frame.

STILL YET ANOTHER OBJECT of the present invention is to provide a chain type pipe vise wherein the frame further includes a pair of parallel rods.

YET STILL ANOTHER OBJECT of the present invention is to provide a chain type pipe vise wherein each of pair of parallel rods of the frame has a pair of rod ends.

STILL YET ANOTHER OBJECT of the present invention is to provide a chain type pipe vise wherein one of the pair of rod ends of each of the pair of parallel rods of the frame are disposed in the pair of apertures of the top of the inverted substantially U-shaped first end plate of the frame.

YET STILL ANOTHER OBJECT of the present invention is to provide a chain type pipe vise wherein another one of the pair of rod ends of each of the pair of parallel rods of the frame are disposed in the pair of apertures of the top of the inverted substantially U-shaped second end plate of the frame.

STILL YET ANOTHER OBJECT of the present invention is to provide a chain type pipe vise wherein the pair of parallel rods of the frame are continuously threaded with nuts and rotatively mounted in the pair of apertures of the top of the inverted substantially U-shaped first end plate of the frame and rotatively mounted in the pair of apertures of the top of the inverted substantially U-shaped second end plate of the frame so that the at least two clamping main assemblies may be readily displaced along the pair of parallel rods of the frame to the desired position and secured thereto with the nuts and so that any additional amount of the at two clamping main assemblies may be readily added.

YET STILL ANOTHER OBJECT of the present invention is to provide a chain type pipe vise wherein each of the at least two clamping main assemblies includes a pair of parallel substantially square-shaped plates.

STILL YET ANOTHER OBJECT of the present invention is to provide a chain type pipe vise wherein each of the pair of parallel substantially square-shaped plates of each of the at least two clamping main assemblies has a top with a V-shaped recess disposed thereon for receiving the at least two pipes, a bottom with a pair of apertures disposed therethrough, a front that has an extension with an aperture disposed therethrough, and a back.

YET STILL ANOTHER OBJECT of the present invention is to provide a chain type pipe vise wherein each of the at least two clamping main assemblies further includes a connecting plate that connects the pair of substantially square-shaped plates of each of the at least two clamping main assemblies to each other at the back of each of the pair of parallel substantially square-shaped plates of each of the at least two clamping main assemblies.

STILL YET ANOTHER OBJECT of the present invention is to provide a chain type pipe vise wherein the connecting plate of the back of each of the pair of parallel substantially square-shaped plates of each of the at least two clamping main assemblies has a plurality of vertically disposed substantially downwardly oriented sprocket chain retaining pegs disposed thereon.

YET STILL ANOTHER OBJECT of the present invention is to provide a chain type pipe vise wherein the at least two clamping main assemblies slidably move on the frame with the pair of parallel rods of the frame passing freely through the pair of apertures of the bottom of each of the pair of parallel substantially square-shaped plates of each of the at least two clamping main assemblies.

STILL YET ANOTHER OBJECT of the present invention is to provide a chain type pipe vise wherein the clamping sub-assembly connects the pair of parallel substantially square-shaped plates of each of the at least two clamping main assemblies to each other at the front of each of the pair of parallel substantially square-shaped plates of each of the at least two clamping assemblies.

YET STILL ANOTHER OBJECT of the present invention is to provide a chain type pipe vise wherein the clamping sub-assembly of each of the at least two clamping main assemblies includes a pivotable rod with a lateral throughbore.

STILL YET ANOTHER OBJECT of the present invention is to provide a chain type pipe vise wherein the pivotable rod of the clamping sub-assembly of each of the at least two clamping main assemblies is pivotally mounted in the aperture of the extension of the front of each of the pair of parallel substantially square-shaped plates of the at least two clamping main assemblies.

YET STILL ANOTHER OBJECT of the present invention is to provide a chain type pipe vise wherein the clamping sub-assembly of each of the at least two clamping main assemblies further includes a threaded rod that has a first end with a lateral throughbore and a second end.

STILL YET ANOTHER OBJECT of the present invention is to provide a chain type pipe vise wherein the threaded rod of the clamping sub-assembly of each of the at least two clamping main assemblies passes through the lateral throughbore of the pivotable rod of the clamping sub-assembly of each of the pair of clamping main assemblies with the first end of the threaded rod of the clamping sub-assembly of each of the at least two clamping main assemblies facing generally towards the back of each of the pair of parallel substantially square shaped plates of each of the at least two clamping main assemblies.

YET STILL ANOTHER OBJECT of the present invention is to provide a chain type pipe vise wherein the clamping sub-assembly of each of the at least two clamping main assemblies further includes a first pivot pin that passes through the lateral throughbore of the first end of the threaded rod of the clamping sub-assembly of each of the at least two clamping main assemblies.

STILL YET ANOTHER OBJECT of the present invention is to provide a chain type pipe vise wherein the clamping sub-assembly of each of the at least two clamping main assemblies further includes a yoke that is mounted to the first pivot pin of the clamping sub-assembly of each of the at least two clamping main assemblies.

YET STILL ANOTHER OBJECT of the present invention is to provide a chain type pipe vise wherein the clamping sub-assembly of each of the at least two clamping main assemblies further includes a sprocket chain that has a first end and a second end.

STILL YET ANOTHER OBJECT of the present invention is to provide a chain type pipe vise wherein the first end of the sprocket chain of the clamping sub-assembly of each of the at least two clamping main assemblies is pivotally mounted to the yoke of the clamping sub-assembly of each of the at least two clamping main assemblies.

YET STILL ANOTHER OBJECT of the present invention is to provide a chain type pipe vise wherein the second end of the sprocket chain of the clamping sub-assembly of each of the at least two clamping main assemblies is removably mounted to the plurality of vertically disposed substantially downwardly oriented sprocket chain retaining pegs of the connecting plate of the back of each of the pair of parallel substantially square-shaped plates of each of the at least two clamping main assemblies.

STILL YET ANOTHER OBJECT of the present invention is to provide a chain type pipe vise wherein the clamping sub-assembly of each of the at least two clamping main assemblies further includes an internally threaded tube that has a first end and a second end with a lateral throughbore.

YET STILL ANOTHER OBJECT of the present invention is to provide a chain type pipe vise wherein the internally threaded tube of the clamping sub-assembly of each of the at least two clamping main assemblies threadably receives the second end of the threaded rod of the clamping sub-assembly of each of the at least two clamping main assemblies with the first end of the internally threaded tube of the clamping sub-assembly of each of the at least two clamping main assemblies in substantial abutment with the pivotable rod of the clamping sub-assembly of each of the at least two clamping main assemblies.

STILL YET ANOTHER OBJECT of the present invention is to provide a chain type pipe vise wherein the clamping sub-assembly of each of the at least two clamping main assemblies further includes a second pivot pin that passes through the lateral throughbore of the second end of the internally threaded tube of the clamping sub-assembly of each of the at least to clamping main assemblies.

YET STILL ANOTHER OBJECT of the present invention is to provide a chain type pipe vise wherein the clamping sub-assembly of each of the at least two clamping main assemblies further includes a yoke crank that is mounted to the second pivot pin of the clamping sub-assembly of each of the at least two clamping main assemblies.

STILL YET ANOTHER OBJECT of the present invention is to provide a chain type pipe vise wherein the inverted substantially U-shaped first end plate of the frame is a one of the at least two clamping main assemblies with a pair of legs that extend downwardly therefrom.

YET STILL ANOTHER OBJECT of the present invention is to provide a chain type pipe vise wherein the inverted substantially U-shaped second end plate of the frame is another one of the at least two clamping main assemblies with a pair of legs that extend downwardly therefrom.

FINALLY, STILL YET ANOTHER OBJECT of the present invention is to provide a method of using a chain type pipe vise that includes the steps of placing the chain type pipe vise on a work surface, clearing a first sprocket chain of a clamping sub-assembly of at least two clamping main assemblies of the chain type pipe vise from a frame of the chain type pipe vise, positioning a one of the at least two clamping main assemblies on the frame, placing a first pipe in a V-shaped recess of a top of each of a pair of parallel substantially square-shaped plates of the at least two clamping main assemblies, placing the first sprocket chain over the first pipe, engaging a second end of the first sprocket chain with a plurality of vertically disposed substantially downwardly oriented sprocket chain retaining pegs of a connecting plate of a back of each of the pair of parallel substantially square-shaped plates, rotating a yoke crank of the clamping sub-assembly and causing a threaded rod of the clamping sub-assembly to be threaded into an internally threaded tube of the clamping sub-assembly that abuts a pivot pin of the clamping sub-assembly of each of the at least two and thereby tightening the first sprocket chain about the first pipe, and repeating the aforementioned second through seventh steps for a second pipe.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of a first embodiment of the present invention being utilized to simultaneously hold two pipes in alignment with each other;

FIG. 2 is a diagrammatic top plan view, with parts broken away, taken in the direction of arrow 2 in FIG. 1;

FIG. 3 is an diagrammatic side elevational view taken in the direction of arrow 3 in FIG. 1 and arrow 3 in FIG. 2;

FIG. 4 is an enlarged cross sectional view, with parts broken away, taken on line 4—4 in FIG. 3;

FIG. 5 is an enlarged diagrammatic partial view taken in the direction of arrow 5 in FIG. 2; and FIG. 6 is a diagrammatic perspective view of a second embodiment of the present invention being utilized to simultaneously hold two pipes in alignment with each other and a fitting disposed thereon.

LIST OF REFERENCE NUMERALS UTILIZED IN THE DRAWING

Preferred Embodiment

10 chain type pipe vise of the present invention
12 work surface
14 first pipe
15 first sprocket chain
16 second pipe
17 second sprocket chain
18 frame
20 pair of clamping main assemblies
22 inverted substantially U-shaped first end plate
24 first end plate top
26 pair of first end plate top apertures
28 inverted substantially U-shaped second end plate
30 second end plate top
32 pair of second end plate top apertures
34 pair of parallel rods
36 pair of rod ends
38 pair of parallel substantially square-shaped plates
40 plate top
41 plate top V-shaped recess
42 plate bottom
44 pair of plate bottom apertures
46 plate front
48 plate front extension
50 plate front extension aperture
52 plate back
54 plate back connecting plate
55 plurality of vertically disposed substantially downwardly oriented sprocket chain retaining pegs
56 clamping sub-assembly
58 clamping sub-assembly pivotable rod
62 clamping sub-assembly threaded rod
64 clamping sub-assembly threaded rod first end
66 clamping sub-assembly threaded rod first end lateral throughbore
68 clamping sub-assembly threaded rod second end 69 clamping sub-assembly first pivot pin
70 clamping sub-assembly yoke
72 first sprocket chain first end
74 clamping sub-assembly internally threaded tube
76 clamping sub-assembly internally threaded tube first end
78 clamping sub-assembly internally threaded tube second end
80 clamping sub-assembly internally threaded tube second end lateral throughbore
82 clamping sub-assembly second pivot pin
84 clamping sub-assembly yoke crank
86 first sprocket chain second end Alternate Embodiment 110 chain type pipe vise of the present invention
119 fitting
120 first end clamping main assembly
128 second end clamping main assembly
138 pair of substantially square-shaped plates
139 pair of substantially square-shaped plates
141 pair of plate bottom legs
142 plate bottom
143 pair of plate bottom legs
144 plate bottom

DETAILED DESCRIPTION OF THE PREFERRED EMBODIMENT

Referring now to the figures in which like numerals indicate like parts, and particularly to FIG. 1, the chain type pipe vise of the present invention is shown generally at 10 disposed on a work surface 12 and clamping a first pipe 14 with a first sprocket chain 15 and a second pipe 16 with a second sprocket chain 17 in longitudinal alignment with the first pipe 12 thereon.

The chain type pipe vise 10 includes a frame 18 and a pair of clamping main assemblies 20 slidably mounted to the frame 18.

The configuration of the frame 18 can best be seen in FIGS. 1 and 2, and as such, will be discussed with reference thereto.

The frame 18 includes an inverted substantially U-shaped first end plate 22 with a first end plate top 24 and a pair of first end plate top apertures 26 disposed in proximity to the first end plate top 24 of the inverted substantially U-shaped first end plate 22 of the frame 18. The inverted substantially U-shaped first end plate 22 of the frame 18 may be aluminum or stainless steel, but is not limited to that.

The frame 18 further includes an inverted substantially U-shaped second end plate 28 displaced a distance from, and parallel to, the inverted substantially U-shaped first end plate 22 of the frame 18. The inverted substantially U-shaped second end plate 28 has a second end plate top 30 and a pair of second end plate top apertures 32 disposed in proximity to the second end plate top 28 of the inverted substantially U-shaped second end plate 30 of the frame 18. The inverted substantially U-shaped second end plate 28 of the frame 18 may be aluminum or stainless steel, but is not limited to that.

The frame 18 further includes a pair of parallel rods 34 each of which having a pair of rod ends 36. The pair of parallel rods 34 of the frame 18 may be aluminum or stainless steel, but is not limited to that.

A one of the pair of rod ends 36 of each of the pair of parallel rods 34 of the frame 18 are disposed in the pair of first end plate top apertures 26 of the first end plate top 24 of the inverted substantially U-shaped first end plate 22 of the frame 18.

The other one of the pair of rod ends 36 of each of the pair of parallel rods 34 of the frame 18 are disposed in the pair of second end plate top apertures 32 of the second end plate top 30 of the inverted substantially U-shaped second end plate 28 of the frame 18.

It is to be understood that the pair of parallel rods 34 of the frame 18 may be continuously threaded with nuts (not shown) and mounted in the pair of first end plate top apertures 26 of the first end plate top 24 of the inverted substantially U-shaped first end plate 22 of the frame 18 and in the pair of second end plate top apertures 32 of the second end plate top 30 of the inverted substantially U-shaped second end plate 28 of the frame 18 so that the pair of clamping main assemblies 20 may be readily displaced along the pair of parallel rods 34 of the frame 18 to the desired position and secured thereto with the nuts (not shown) and so that any additional amount of the clamping main assemblies 20 may be readily added.

The configuration of each of the pair of clamping main assemblies 20 can best be seen in FIGS. 1-3, and as such, will be discussed with reference thereto.

Each of the pair of clamping main assemblies 20 includes a pair of parallel substantially square-shaped plates 38. Each of the pair of parallel substantially square-shaped plates 38 of each of the pair of clamping main assemblies 20 may be aluminum or stainless steel, but is not limited to that.

Each of the pair of parallel substantially square-shaped plates 38 of each of the pair of clamping main assemblies 20 has a plate top 40 with a plate top V-shaped recess 41 disposed thereon for receiving the first pipe 14 and a second pipe 16, a plate bottom 42 with a pair of plate bottom apertures 44 disposed therethrough, a plate front 46 having a plate front extension 48 with a plate front extension aperture 50 disposed therethrough, and a plate back 52.

A plate back connecting plate 54 connects the pair of substantially square-shaped plates 38 of each of the pair of clamping main assemblies 20 to each other at the plate back 52 of each of the pair of parallel substantially square-shaped plates 38 of each of the pair of clamping main assemblies 20. The plate back connecting plate 54 of the plate back 52 of each of the pair of parallel substantially square-shaped plates 38 of each of the pair of clamping main assemblies 20 may be aluminum or stainless steel, but is not limited to that.

The plate back connecting plate 54 of the plate back 52 of each of the pair of parallel substantially square-shaped plates 38 of each of the pair of clamping main assemblies 20 has a plurality of vertically disposed substantially downwardly oriented sprocket chain retaining pegs 55 disposed thereon. The plurality of vertically disposed substantially downwardly oriented sprocket chain retaining pegs 55 of the plate back connecting plate 54 of the plate back 52 of each of the pair of parallel substantially square-shaped plates 38 of each of the pair of clamping main assemblies 20 may be aluminum or stainless steel, but is not limited to that.

The pair of clamping main assemblies 20 slidably move on the frame 18 with the pair of parallel rods 34 of the frame 18 passing freely through the pair of plate bottom apertures 44 of the plate bottom 42 of each of the pair of parallel substantially square-shaped plates 38 of each of the pair of clamping main assemblies 20.

A clamping sub-assembly 56 connects the pair of parallel substantially square-shaped plates 38 of each of the pair of clamping main assemblies 20 to each other at the plate front 46 of each of the pair of parallel substantially square-shaped plates 38 of each of the pair of clamping assemblies 20.

The configuration of the clamping sub-assembly 56 can best be seen in FIGS. 3–5, and as such, will be discussed with reference thereto.

As shown in FIG. 4, the clamping sub-assembly 56 of each of the pair of clamping main assemblies 20 includes a clamping sub-assembly pivotable rod 58 pivotally mounted in the plate front extension aperture 50 of the plate front extension 48 of the plate front 46 of each of the pair of parallel substantially square-shaped plates 38 of the clamping sub-assembly 56 of each of the pair of clamping main assemblies 20. The clamping sub-assembly pivotable rod 58 of the clamping sub-assembly 56 of each of the pair of clamping main assemblies 20 may be aluminum or stainless steel, but is not limited to that.

The clamping sub-assembly pivotable rod 58 of the clamping sub-assembly 56 of each of the pair of clamping main assemblies 20 has a clamping sub-assembly rod lateral throughbore 60 disposed therethrough.

A clamping sub-assembly threaded rod 62 having a clamping sub-assembly threaded rod first end 64 with a clamping sub-assembly threaded rod first end lateral throughbore 66 and a clamping sub-assembly threaded rod second end 68 passes through the clamping sub-assembly pivotable rod lateral throughbore 60 of the clamping sub-assembly pivotable rod 58 of the clamping sub-assembly 56 of each of the pair of clamping main assemblies 20 with the clamping sub-assembly threaded rod first end 64 of the clamping sub-assembly threaded rod 62 of the clamping sub-assembly 56 of each of the pair of clamping main assemblies 20 facing generally towards the plate back 52 of each of the pair of parallel substantially square-shaped plates 38 of each of the pair of clamping main assemblies 20. The clamping sub-assembly threaded rod 62 of the clamping sub-assembly 56 of each of the pair of clamping main assemblies 20 may be aluminum or stainless steel, but is not limited to that.

A clamping sub-assembly first pivot pin 69 passes through the clamping sub-assembly threaded rod first end lateral throughbore 66 of the clamping sub-assembly threaded rod first end 64 of the clamping sub-assembly threaded rod 62 of the clamping sub-assembly 56 of each of the pair of clamping main assemblies 20. The clamping sub-assembly first pivot pin 69 of the clamping sub-assembly 56 of each of the pair of clamping main assemblies 20 may be aluminum or stainless steel, but is not limited to that.

A clamping sub-assembly yoke 70 is mounted to the clamping sub-assembly first pivot pin 69 of the clamping sub-assembly 56 of each of the pair of clamping main assemblies 20 and is further pivotally mounted to a first sprocket chain first end 72 of the first sprocket chain 15. The clamping sub-assembly yoke 70 of the clamping sub-assembly 56 of each of the pair of clamping main assemblies 20 may be aluminum or stainless steel, but is not limited to that.

A clamping sub-assembly internally threaded tube 74 having a clamping sub-assembly internally threaded tube first end 76 and a clamping sub-assembly internally threaded tube second end 78 with a clamping sub-assembly internally threaded tube second end lateral throughbore 80 threadably receives the clamping sub-assembly threaded rod second end 68 of the clamping sub-assembly threaded rod 62 of the clamping sub-assembly 56 of each of the pair of clamping main assemblies 20 with the clamping sub-assembly internally threaded tube first end 76 of the clamping sub-assembly internally threaded tube 68 of the clamping sub-assembly 56 of each of the pair of clamping main assemblies 20 abutting the clamping sub-assembly pivotable rod 58 of the clamping sub-assembly 56 of each of the pair of clamping main assemblies 20. The clamping sub-assembly internally threaded tube 74 of the clamping sub-assembly 56 of each of the pair of clamping main assemblies 20 may be aluminum or stainless steel, but is not limited to that.

A clamping sub-assembly second pivot pin 82 passes through the clamping sub-assembly internally threaded tube second end lateral throughbore 80 of the clamping sub-assembly internally threaded tube second end 78 of the clamping sub-assembly internally threaded tube 74 of the clamping sub-assembly 56 of each of the pair of clamping main assemblies 20. The clamping sub-assembly second pivot pin 82 of the clamping sub-assembly 56 of each of the pair of clamping main assemblies 20 may be aluminum or stainless steel, but is not limited to that.

A clamping sub-assembly yoke crank 84 is pivotally mounted to the clamping sub-assembly second pivot pin 82 of the clamping sub-assembly 56 of each of the pair of clamping main assemblies 20. The clamping sub-assembly yoke crank 84 of the clamping sub-assembly 56 of each of the pair of clamping main assemblies 20 may be aluminum or stainless steel, but is not limited to that.

As shown in FIGS. 3 and 5, the first sprocket chain 15 has a first sprocket chain second end 86 that is removably engaged with the plurality of vertically disposed substantially downwardly oriented chain sprocket retaining pegs 55 of the plate back connecting plate 54 of the plate back 52 of each of the pair of parallel substantially square-shaped plates 38 of each of the pair of clamping main assemblies 20.

The operation of the chain type pipe vise 10 can best be seen in FIGS. 1 and 3–5, and as such, will be discussed with reference thereto.

The chain type pipe vise 10 is placed on the work surface 12.

The first sprocket chain 15 is cleared of the respective one of the pair of clamping main assemblies 20.

The first pipe 14 is placed in the plate top V-shaped recess 41 of the plate top 40 of each of the pair of parallel substantially square-shaped plates 38 of the respective one of the pair of clamping main assemblies 20.

The first sprocket chain 15 is placed over the first pipe 14.

The first sprocket chain second end 86 of the first sprocket chain 15 is engaged with the plurality of vertically disposed substantially downwardly oriented sprocket chain retaining pegs 55 of the plate back connecting plate 54 of the plate back 52 of each of the pair of parallel substantially square-shaped plates 38 of the respective one of the pair of clamping main assemblies 20.

The clamping sub-assembly yoke crank 84 of the respective clamping sub-assembly 56 of the respective one of the pair of clamping main assemblies 20 is rotated causing the clamping sub-assembly threaded rod 62 of the clamping sub-assembly 56 of the respective one of the pair of clamping main assemblies 20 to be threaded into the clamping sub-assembly internally threaded tube 74 of the clamping sub-assembly 56 of the respective one of the pair of clamping main assemblies 20 and thereby tightening the first sprocket chain 15 about the first pipe 14.

It is to be understood, however, that if the first sprocket chain 15 is not fully tightened about the first pipe 14 when the clamping sub-assembly internally threaded tube second end 68 of the clamping sub-assembly internally threaded tube 68 of the clamping sub-assembly 56 of the respective one of the pair of clamping main assemblies 20 abuts substantially against the clamping sub-assembly second pivot pin 82 of the clamping sub-assembly 56 of the respective one of the pair of clamping main assemblies 20, that is bottoms out, the first sprocket chain second end 86 of the first sprocket chain 15 is removed from engagement with the plurality of vertically disposed substantially downwardly oriented sprocket chain retaining pegs 55 of the plate back connecting plate 54 of the plate back 52 of each of the pair of parallel substantially square-shaped plates 38 of the respective one of the pair of clamping main assemblies 20 and is moved downwardly so that the plurality of vertically disposed substantially downwardly oriented sprocket chain retaining pegs 55 of the plate back connecting plate 54 of the plate back 52 of each of the pair of parallel substantially square-shaped plates 38 of the respective one of the pair of clamping main assemblies 20 engages a higher portion of the first sprocket chain second end 86 of the first sprocket chain 15 and eliminating the slack in the first sprocket chain 15.

The second pipe 16 is retained in abutting alignment, by the second sprocket chain 17, in the same manner as the first pipe 14.

The configuration and operation of the alternate embodiment of the chain type pipe vise 110 can best be seen in FIG. 6, and as such, will be discussed with reference thereto.

The chain type pipe vise 110 is shown retaining the first pipe 14, retaining the second pipe 16 in longitudinal alignment with the first pipe 14, and retaining a fitting 119 on the second pipe 14.

The chain type pipe vise 110 is substantially similar to the chain type pipe vise 10 except for the configuration of the inverted substantially U-shaped first end plate 22 of the frame 18 and the configuration of the inverted substantially U-shaped second end plate 28 of the frame 18.

The inverted substantially U-shaped first end plate 22 of the frame 18 is replaced by a first end clamping main assembly 120 that is substantially similar to the clamping main assembly 20 except that the clamping main assembly 120 rests on the work surface 12 by a pair of plate bottom legs 141 that extend downwardly from a plate bottom 142 of each of a pair of parallel substantially square-shaped plates 138 of the first end clamping main assembly 120.

The inverted substantially U-shaped second end plate 28 of the frame 18 is replaced by a second end clamping main assembly 128 that is substantially similar to the clamping main assembly 20 except that the clamping main assembly 120 rests on the work surface 12 by a pair of plate bottom legs 143 that extend downwardly from a plate bottom 144 of each of a pair of parallel substantially square-shaped plates 139 of the second end clamping main assembly 128.

It will be understood that each of the elements described above, or two or more together, may also find a useful application in other types of constructions differing from the types described above.

While the invention has been illustrated and described as embodied in a chain type pipe vise, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A portable chain type pipe vise, comprising:

a) a frame resting on a work surface in a stable manner when said portable chain type pipe vise is being utilized; said frame including an inverted substantially U-shaped first end plate having a top and a pair of apertures disposed in proximity to said top of said inverted substantially U-shaped first end plate of said frame; said frame further including an inverted substantially U-shaped second end plate displaced a distance from, and parallel to, said inverted substantially U-shaped first end plate of said frame; said inverted substantially U-shaped second end plate having a top and a pair of apertures disposed in proximity to said top of said inverted substantially U-shaped second end plate of said frame; said frame further including a pair of parallel rods; each of said pair of parallel rods of said frame having a pair of rod ends; one of said pair of rod ends of each of said pair of parallel rods of said frame being disposed in said pair of apertures of said top of said inverted substantially U-shaped first end plate of said frame; another one of said pair of rod ends of each of said pair of parallel rods of said frame being disposed in the pair of apertures of said top of said inverted substantially U-shaped second end plate of said frame;

b) at least two clamping main assemblies longitudinally movable on said frame so as to allow at least two pipes to be rested in longitudinal alignment with each other; each of said at least two clamping main assemblies including a pair of parallel substantially square-shaped plates; each of said pair of parallel substantially square-shaped plates of each of said at least two clamping main assemblies having a top with a V-shaped recess disposed thereon for receiving the at least two pipes, a bottom with a pair of apertures disposed therethrough, a front having an extension with an aperture disposed therethrough, and a back; and c) a clamping sub-assembly disposed at each of said at least two clamping main assemblies so as to allow the at least two pipes to be retained in longitudinal alignment with each other.

2. The vise as defined in claim 1, wherein said pair of parallel rods of said frame are continuously threaded with nuts and mounted in said pair of apertures of said top of said inverted substantially U-shaped first end plate of said frame and rotatively mounted in said pair of apertures of said top of said inverted substantially U-shaped second end plate of said frame so that said at least two clamping main assemblies may be readily displaced along said pair of parallel rods of said frame to the desired position and secured thereto with said nuts and so that any additional amount of said at two clamping main assemblies may be readily added.

3. The vise as defined in claim 1, wherein each of said at least two clamping main assemblies further includes a connecting plate that connects said pair of substantially square-shaped plates of each of said at least two clamping main assemblies to each other at said back of each of said pair of parallel substantially square-shaped plates of each of said at least two clamping main assemblies.

4. The vise as defined in claim 3, wherein said connecting plate on said back of each of said pair of parallel substantially square-shaped plates of each of said at least two clamping main assemblies has a plurality of pegs disposed thereon that extend substantially downwardly therefrom.

5. The vise as defined in claim 4, wherein said at least two clamping main assemblies slidably move on said frame with said pair of parallel rods of said frame passing freely through said pair of apertures of said bottom of each of said pair of parallel substantially square-shaped plates of each of said at least two clamping main assemblies.

6. The vise as defined in claim 5, wherein said clamping sub-assembly connects said pair of parallel substantially square-shaped plates of each of said at least two clamping main assemblies to each other at said front of each of said pair of parallel substantially square-shaped plates of each of said at least two clamping assemblies.

7. The vise as defined in claim 6, wherein said clamping sub-assembly of each of said at least two clamping main assemblies includes a pivotable rod with a lateral throughbore, said pivotable rod of said clamping sub-assembly of each of said at least two clamping main assemblies is pivotally mounted in said aperture of said extension of said front of each of said pair of parallel substantially square-shaped plates of said at least two clamping main assemblies.

8. The vise as defined in claim 7, wherein said clamping sub-assembly of each of said at least two clamping main assemblies further includes a threaded rod that has a first end with a lateral throughbore and a second end, said threaded rod of said clamping sub-assembly of each of said at least two clamping main assemblies passes through said lateral throughbore of said pivotable rod of said clamping sub-assembly of each of said pair of clamping main assemblies with said first end of said threaded rod of said clamping sub-assembly of each of said at least two clamping main assemblies facing generally towards said back of each of said pair of parallel substantially square shaped plates of each of said at least two clamping main assemblies.

9. The vise as defined in claim 8, wherein said clamping sub-assembly of each of said at least two clamping main assemblies further includes a first pivot pin that passes through said lateral throughbore of said first end of said threaded rod of said clamping sub-assembly of each of said at least two clamping main assemblies.

10. The vise as defined in claim 9, wherein said clamping sub-assembly of each of said at least two clamping main assemblies further includes a yoke that is mounted to said first pivot pin of said clamping sub-assembly of each of said at least two clamping main assemblies.

11. The vise as defined in claim 10, wherein said clamping sub-assembly of each of said at least two clamping main assemblies further includes a sprocket chain that has a first end and a second end, said first end of said sprocket chain of said clamping sub-assembly of each of said at least two clamping main assemblies is pivotally mounted to said yoke of said clamping sub-assembly of each of said at least two clamping main assemblies, said second end of said sprocket chain of said clamping sub-assembly of each of said at least two clamping main assemblies is removably mounted to said plurality of vertically disposed substantially downwardly oriented sprocket chain retaining pegs of said connecting plate of said back of each of said pair of parallel substantially square-shaped plates of each of said at least two clamping main assemblies.

12. The vise as defined in claim 11, wherein said clamping sub-assembly of each of said at least two clamping main assemblies further includes an internally threaded tube that has a first end and a second end with a lateral throughbore, said internally threaded tube of said clamping sub-assembly of each of said at least two clamping main assemblies threadably receives said second end of said threaded rod of said clamping sub-assembly of each of said at least two clamping main assemblies with said first end of said internally threaded tube of said clamping sub-assembly of each of said at least two clamping main assemblies in substantial abutment with said pivotable rod of said clamping sub-assembly of each of said at least two clamping main assemblies.

13. The vise as defined in claim 12, wherein said clamping sub-assembly of each of said at least two clamping main assemblies further includes a second pivot pin that passes through said lateral throughbore of said second end of said internally threaded tube of said clamping sub-assembly of each of said at least to clamping main assemblies.

14. The vise as defined in claim 13, wherein said clamping sub-assembly of each of said at least two clamping main assemblies further includes a yoke crank that is mounted to said second pivot pin of said clamping sub-assembly of each of said at least two clamping main assemblies.

15. The vise as defined in claim 14, wherein said inverted substantially U-shaped first end plate of said frame is a one of said at least two clamping main assemblies with a pair of legs that extend downwardly therefrom, said inverted substantially U-shaped second end plate of said frame is another one of said at least two clamping main assemblies with a pair of legs that extend downwardly therefrom.

* * * * *